US006879288B2

(12) United States Patent
Byrne et al.

(10) Patent No.: US 6,879,288 B2
(45) Date of Patent: Apr. 12, 2005

(54) INTERIOR PATCH ANTENNA WITH GROUND PLANE ASSEMBLY

(75) Inventors: Steven V. Byrne, Burton, MI (US); Nazar F. Bally, Sterling Heights, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/458,794

(22) Filed: Jun. 10, 2003

(65) Prior Publication Data

US 2004/0252057 A1 Dec. 16, 2004

(51) Int. Cl.[7] ..... H01Q 1/38
(52) U.S. Cl. ..... 343/700 MS; 343/789
(58) Field of Search ..... 343/700 MS, 789, 343/829, 846, 841

(56) References Cited

U.S. PATENT DOCUMENTS 4,415,900 A * 11/1983 Kaloi ..... 343/700 MS
4,675,685 A * 6/1987 Finken ..... 343/708
5,025,264 A * 6/1991 Stafford ..... 343/767
5,648,785 A 7/1997 Nagy et al. ..... 343/713
5,714,959 A 2/1998 Troy et al. ..... 343/713
5,990,835 A * 11/1999 Kuntzsch et al. .... 343/700 MS
6,353,415 B1 3/2002 Ashtiani et al. ..... 343/713
6,359,588 B1 * 3/2002 Kuntzsch ..... 343/700 MS
6,462,710 B1 * 10/2002 Carson et al. ..... 343/700 MS

* cited by examiner

*Primary Examiner*—Tho Phan
(74) *Attorney, Agent, or Firm*—Stefan V. Chmielewski

(57) ABSTRACT

The present invention provides an antenna unit that eliminates the need for an EMI shield to protect the sensitive components of the antenna unit's circuit board from EMI. The antenna unit includes a planar member composed of a material operating as a ground plane for the antenna unit, the ground plane defining a cavity; a circuit board secured to the ground plane, the circuit board including a platform and at least one circuit board component, the platform covering the cavity so as to enclose the circuit board component within the cavity, and an antenna positioned adjacent to the platform and in communication with the circuit board.

27 Claims, 7 Drawing Sheets

INTERIOR PATCH ANTENNA WITH GROUND PLANE ASSEMBLY

TECHNICAL BACKGROUND

The invention generally relates to satellite signal receiving systems, and more particularly to antennas used in such systems.

BACKGROUND OF THE INVENTION

Antenna units presently used in Global Positioning Systems ("GPS") and Satellite Digital Audio Radio ("SDAR") systems typically include a conductive ground plane, a circuit board assembly having circuit board components protected by an electromagnetic interference ("EMI") shield and an antenna patch centered above the ground plane. As described, these antenna units are complex due to the number of components and their required hand assembly, and such complexities are partially responsible for both high manufacturing costs and long manufacturing time.

A prior art antenna unit using an EMI shield is shown in FIG. 1. Antenna unit 10 includes EMI shield 14 secured to circuit board 18. EMI shield 14 includes top cover 14*a*, which defines ground plane 16, and bottom cover 14*b*. Antenna 12 is attached to ground plane 16. EMI shield 14 is used to shield circuit board components 20 from EMI.

U.S. Pat. No. 6,522,291 to Noguchi et al. teaches a GPS antenna with an EMI shield. Shown in FIG. 2, circuit board 20 is covered by EMI shield 40. Electric components mounted to circuit board 20 form electrical circuits, and EMI shield 40 is designed to shield the electrical circuits. EMI shield 40 is composed of top cover 41 and bottom cover 51, and top flat plane 42 of top cover 41 defines a ground plane of GPS antenna 10.

SUMMARY OF THE INVENTION

The present invention eliminates the complexity in present antenna units by providing an antenna unit without the EMI shield, thereby enabling a less expensive antenna unit to be made in a faster amount of time. By enclosing the EMI sensitive components of the antenna unit's circuit board within a cavity defined in the antenna unit's ground plane, the present invention minimizes the exposure of the circuit board components to EMI.

In one embodiment of the present invention, an antenna unit includes a planar member composed of a material operating as a ground plane for the antenna unit, the ground plane defining a cavity; a circuit board secured to the ground plane, the circuit board including a platform and at least one circuit board component, the platform covering the cavity so as to enclose the circuit board component within the cavity; and an antenna positioned adjacent to the platform and in communication with the circuit board.

In another embodiment of the present invention, the antenna unit includes a planar member operating as a ground plane, the ground plane defining a cavity; a circuit board secured to the ground plane, the circuit board including a platform having a top surface-and a bottom surface, the bottom surface containing at least one circuit board component, wherein the platform covers the cavity so as to enclose the circuit board component within the cavity; and an antenna mounted to the top surface of the platform.

In yet another embodiment of the present invention, the antenna unit includes an antenna capable of receiving satellite signals, the antenna coupled to a circuit board including a platform; the antenna including a planar member operating as a ground plane, the ground plane defining a cavity; the circuit board secured to the ground plane and containing at least one circuit board component, wherein the platform covers the cavity and encapsulates the circuit board component within the cavity; and a protective layer covering the antenna.

BRIEF DESCRIPTION OF THE DRAWINGS

The above-mentioned and other features and objects of this invention, and the manner of attaining them, will become more apparent and the invention itself will be better understood by reference to the following description of an embodiment of the invention taken in conjunction with the accompanying drawings, wherein.

Figure 1:
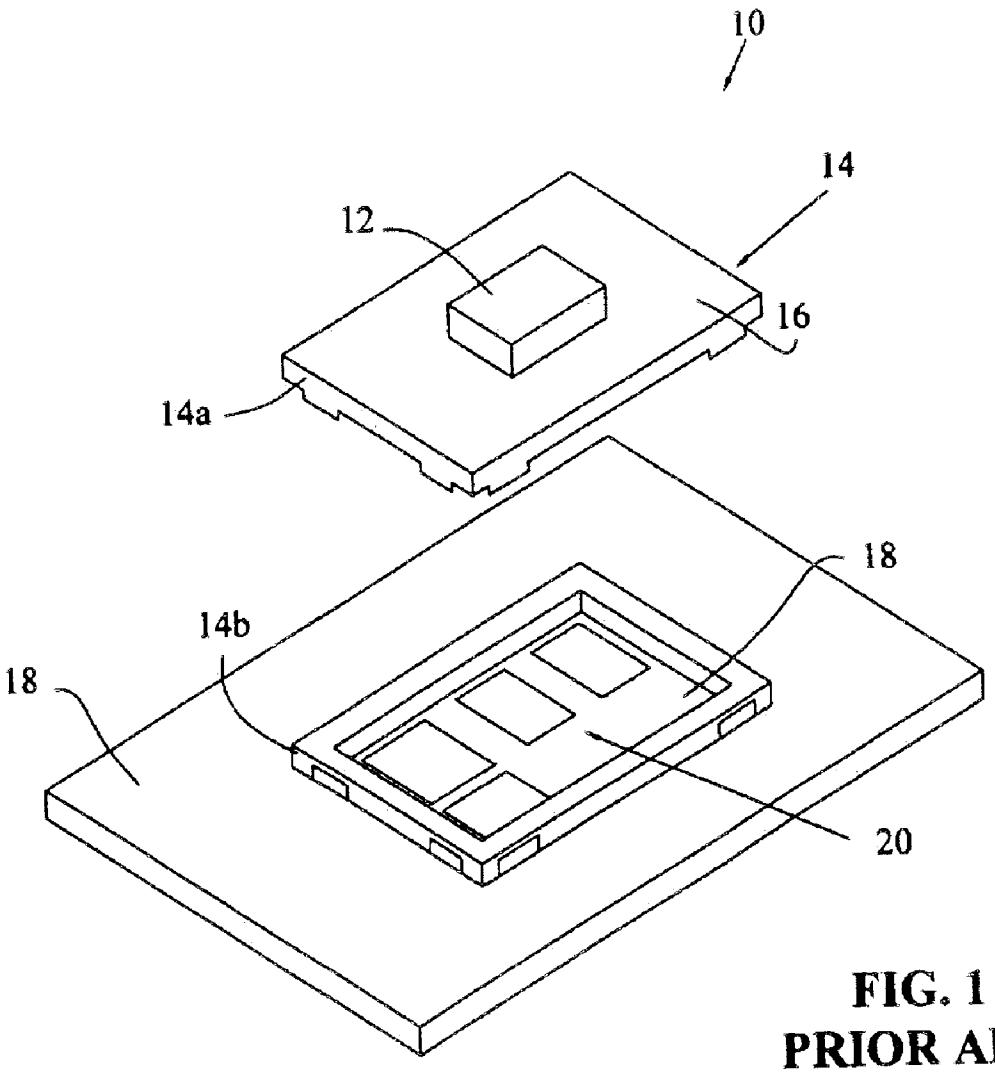
FIG. 1 PRIOR ART
FIG. 1 is an exploded perspective view of a prior art antenna unit.

Corresponding reference characters indicate corresponding parts throughout the several views. Although the drawings represent embodiments of the present invention, the drawings are not necessarily to scale and certain features may be exaggerated in order to better illustrate and explain the present invention. The exemplifications set out herein illustrate embodiments of the invention in several forms and such exemplification is not to be construed as limiting the scope of the invention in any manner.

DESCRIPTION OF INVENTION

The embodiments disclosed below are not intended to be exhaustive or limit the invention to the precise forms disclosed in the following detailed description. Rather, the embodiments are chosen and described so that others skilled in the art may utilize their teachings.

The present invention provides an antenna unit that eliminates the need for an EMI shield to protect the sensitive components of the unit's circuit board from electromagnetic interference. EMI is a disruption of operation of an electronic device when the device is in the vicinity of an electromagnetic field in the radio frequency ("RF") spectrum that is caused by another electronic device.

Figure 2:
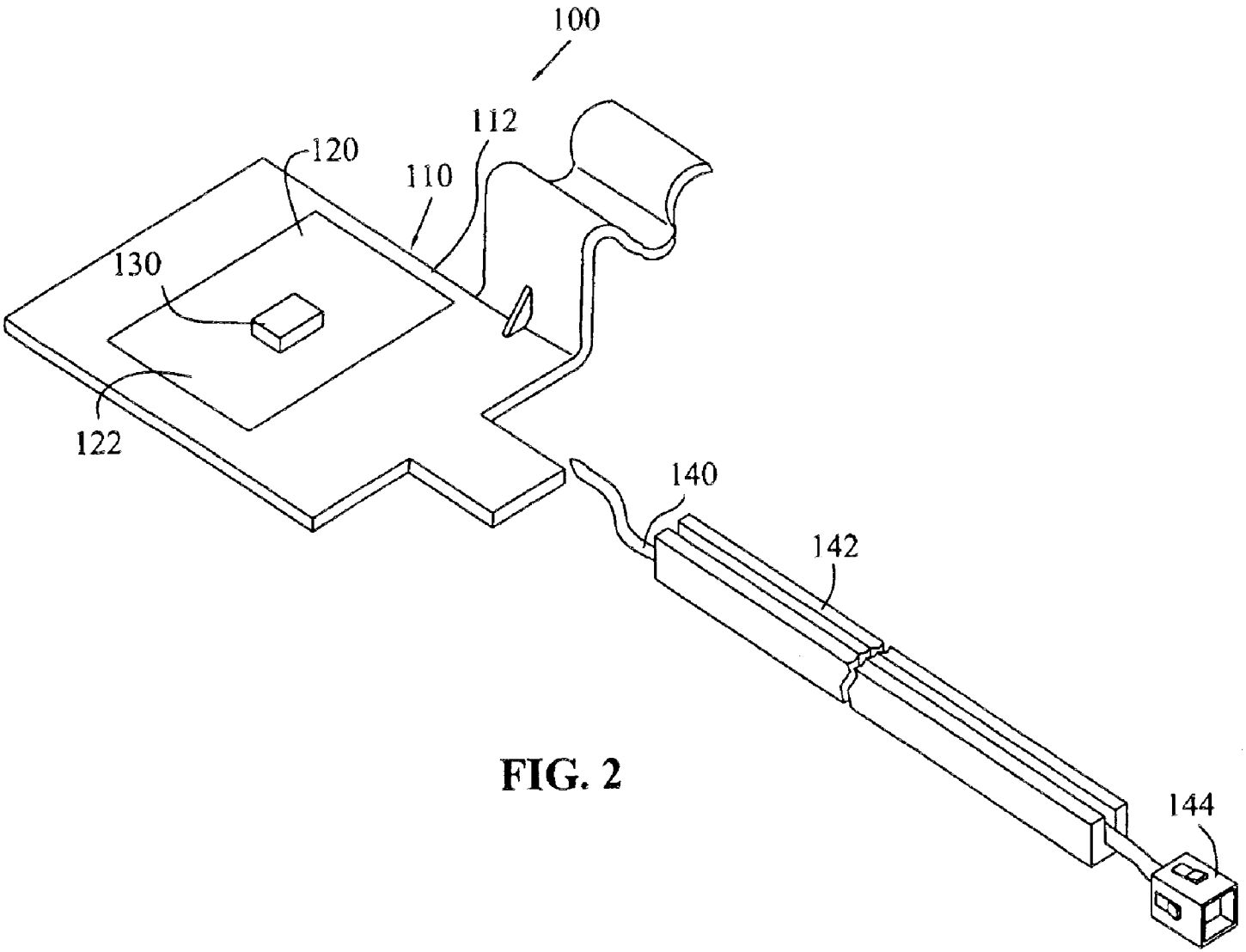
FIG. 2 is a perspective view of one embodiment of the present invention.
Figure 3:
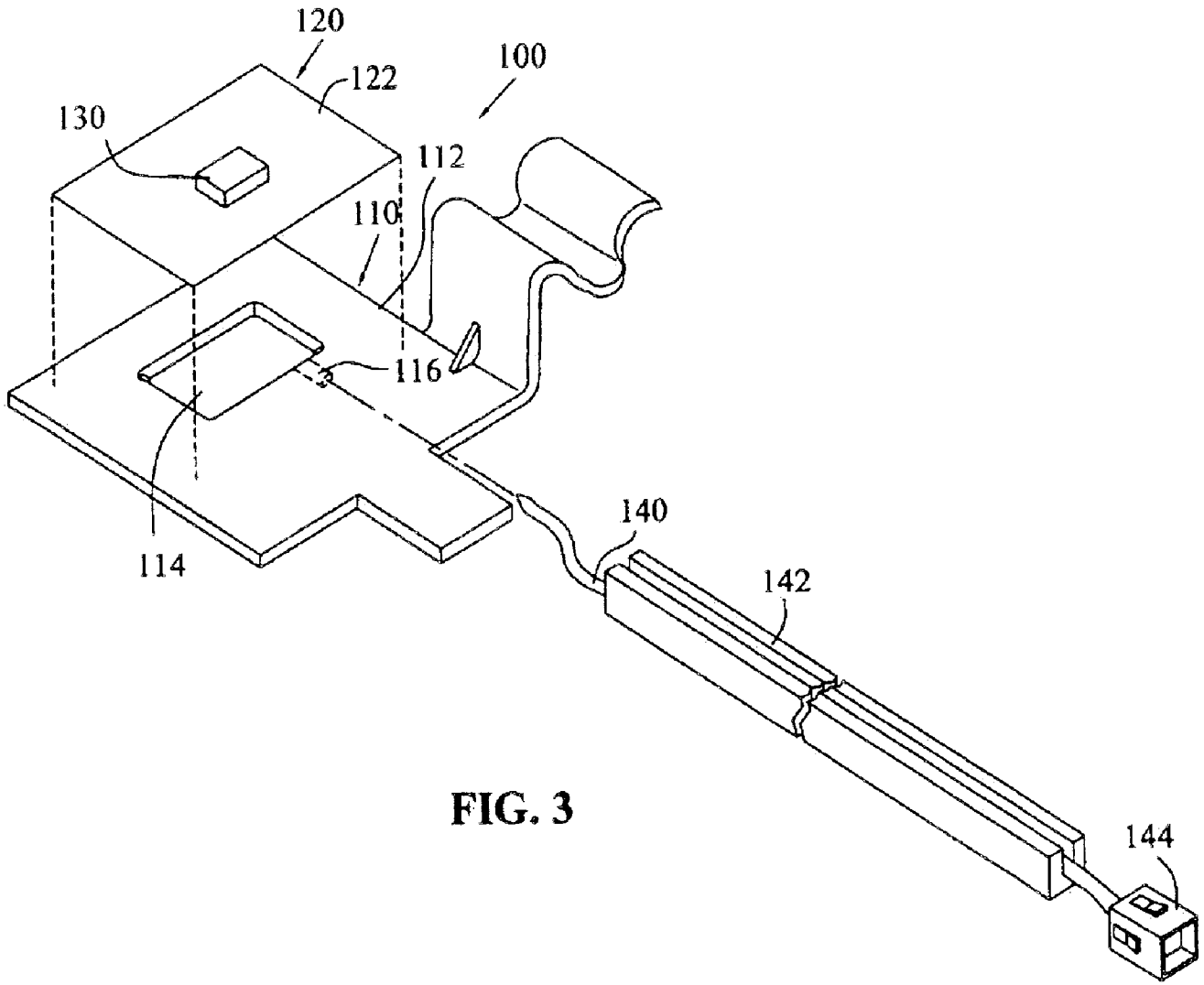
FIG. 3 is an exploded perspective view of one embodiment of the present invention shown in FIG. 2.

One embodiment of the antenna unit of the present invention is shown in FIG. 2. Antenna unit 100 includes planar member 110 operating as a ground plane for antenna unit 100 and defining ground plane surface 112. Planar member, or ground plane, 110 may be composed of any conductive sheet metal, e.g., stainless steel, brass and aluminum. As may be seen by the varying shapes of ground plane 110 in FIGS. 2 and 7, ground plane 110 may be adapted to fit in different vehicles. Referring to FIG. 3, ground plane 110 defines cavity 114 as well as channel 116.

Channel 16 extends outward from cavity 114 and is used for the exit of the jumper assembly. The jumper assembly includes coaxial cable 140, cable wrap 142 (e.g., foam) and connection 144 to connect antenna unit 100 to a GPS and/or a SDAR receiver. Channel 116 also provides radial strain relief for the jumper assembly and may reduce the need for an extra cable fastener.

Figure 6:
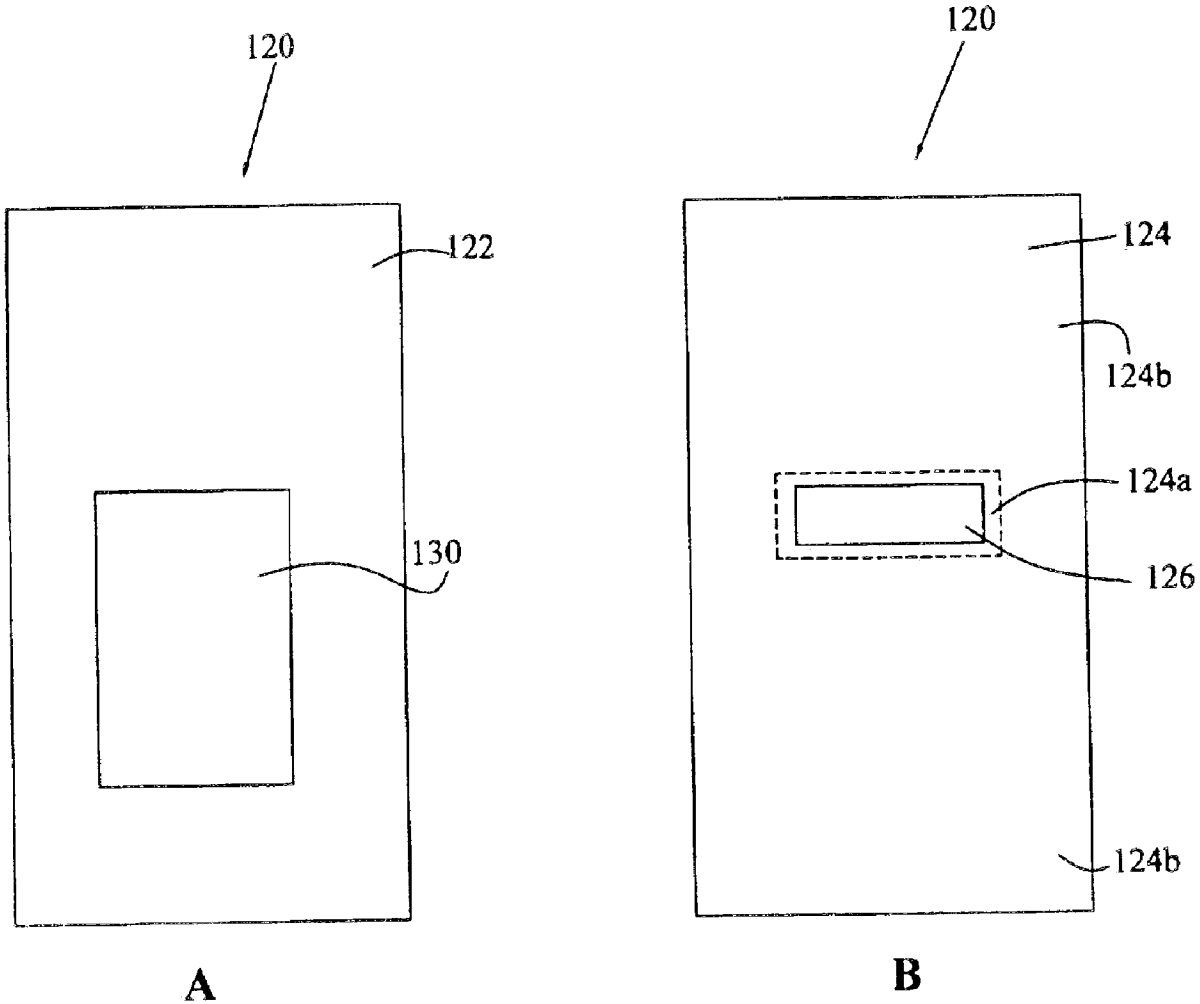
FIG. 6A is a top plan view of the top surface of a circuit board suitable for use with the present invention.
FIG. 6B is a top plan view of the bottom surface of the circuit board shown in FIG. 6A.

Antenna unit 100 also includes a circuit board having platform 120. Shown in detail in FIGS. 6A and 6B, platform 120 includes grounded top surface 122 and bottom surface 124. In an exemplary embodiment of the present invention, antenna 130 is centered above ground plane 110 and mounted to top surface 122 of platform 120 by use of an adhesive, soldering, glue, epoxy, plug, or other conventional attachment method. Antenna 130 also may be positioned in other locations relative to ground plane 110 and adequately perform (e.g., instead of being centered above ground plane 110, antenna 30 may be off-centered). In an exemplary embodiment of the present invention, antenna 130 is a ceramic patch antenna capable of receiving high frequency satellite signals from a plurality of satellites orbiting around the earth. As such, antenna 130 includes a patch supported on a dielectric ceramic which is connected to the circuit board and its components 126 by conventional attachments, e.g., a feed pin depending from the patch. Antenna 130 may be a microstrip patch antenna, a plastic patch antenna, or any type of antenna capable of use in a GPS and/or a SDAR system, including, e.g., helix and dipole antennas.

One or more EMI sensitive circuit board components 126 are mounted to bottom surface 124 of platform 120. Circuit board components 126 include low noise amplifiers ("LNAs"), which listen for RF signals. In other embodiments, circuit board components 126 may include components capable of providing GPS and/or SDAR receiver capabilities, e.g., processors capable of processing the satellite signals either for output to a radio system or for computing the geographic location of antenna 130, analog circuits, digital circuits, pre-amplifiers, down converters, A/D converters, digitizers, ROMs, RAMs, EEPROMs, universal serial bus controllers, or chipsets capable of providing the functionality of one or more of these components.

Bottom surface 124 includes populated area 124*a* and unpopulated area 124*b*. Populated area 124*a* is defined by the placement of circuit board components 126. For example, the area in which one circuit board component 126 is mounted creates one populated area 124*a*. Accordingly, any portion of bottom surface 124 that does not include circuit board components 126 is defined as unpopulated area 124*b*.

An exemplary embodiment of the present invention is shown in FIG. 3. Platform 120 of the circuit board is secured to ground plane 110. Specifically, unpopulated area 124*b* of platform 120 is secured to ground plane 110 by conventional attachments, including screws, hook and fasteners, glue, epoxy and adhesives, including thermoformed adhesives. In order to prevent discontinuities in ground plane surface 112, when circuit platform 120 is secured to ground plane 110, ground top surface 122 is positioned near-coplanar with ground plane surface 112 to serve as ground plane surface's 112 extension over cavity 114.

Figure 4:
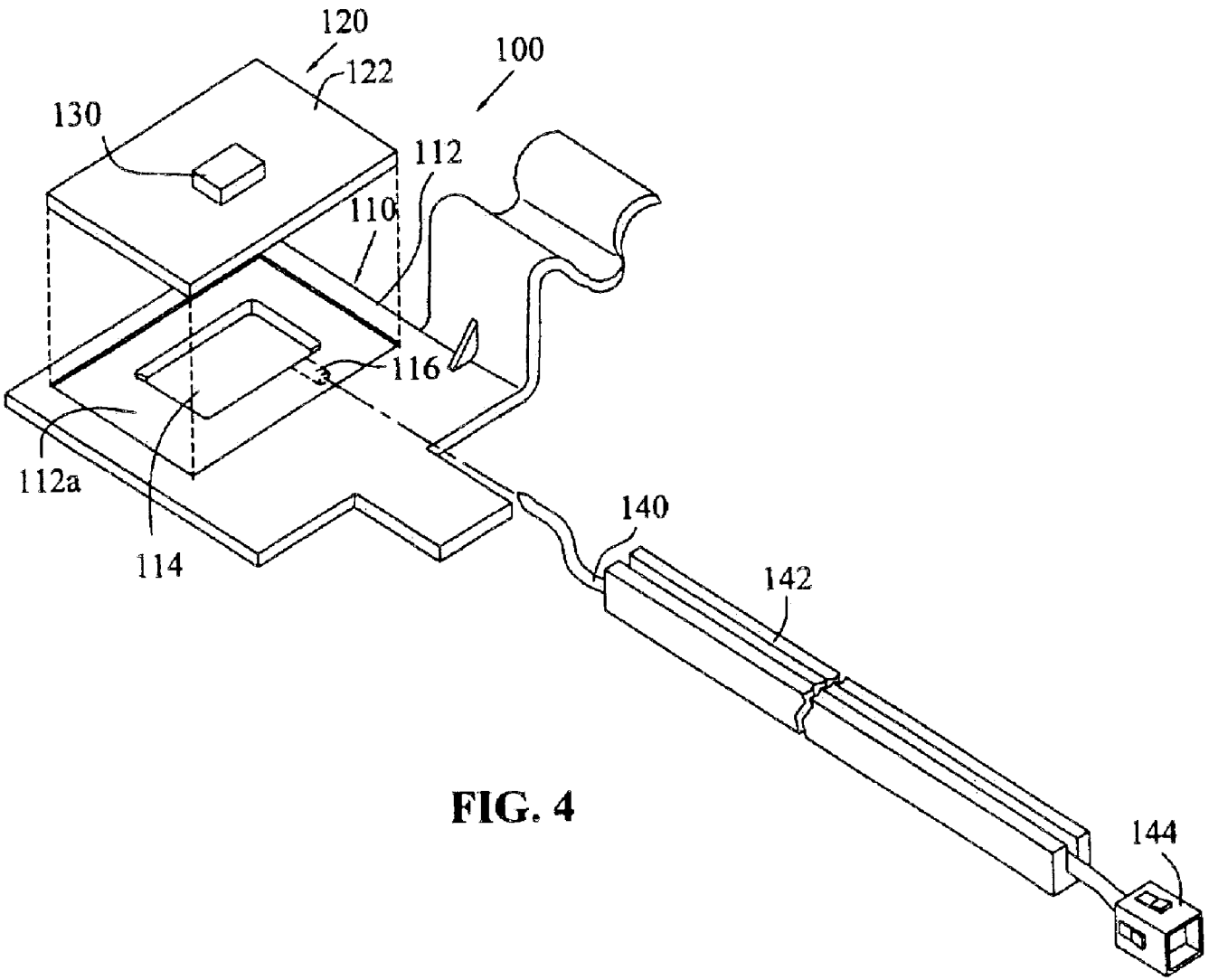
FIG. 4 is an exploded perspective view of another embodiment of the present invention shown in FIG. 2.

In another embodiment of the present invention shown in FIG. 4, ground plane surface 112 includes recessed area 112*a* surrounding cavity 114. In this embodiment, platform 120 may be secured to ground plane 110 at recessed area 112*a*. Unpopulated area 124*b* of platform 120 may be secured to recessed area 112*a* by conventional attachments such that top surface 122 is positioned coplanar or near-coplanar with ground plane surface 112.

Figure 5:
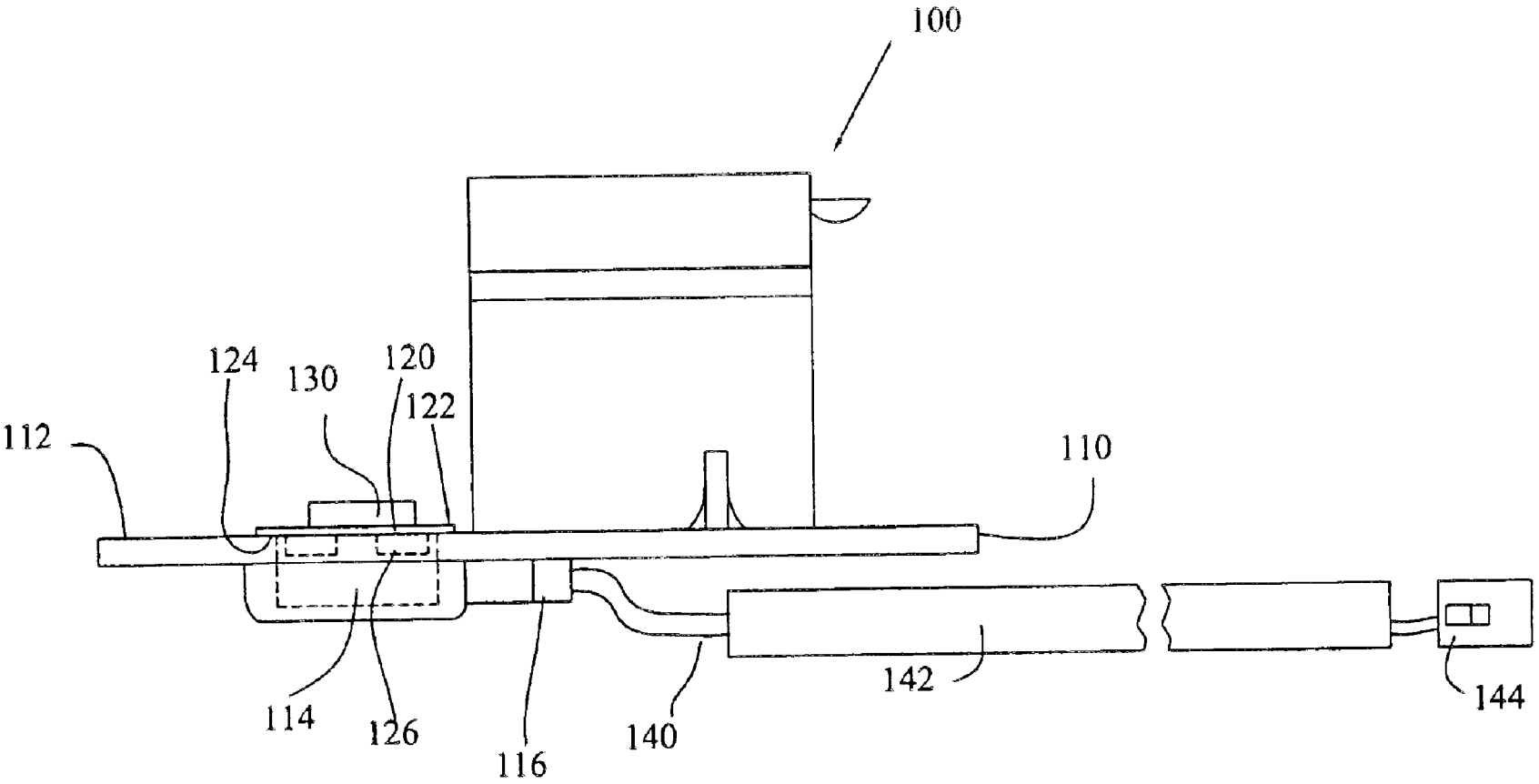
FIG. 5 is a side perspective view of the embodiment of the present invention shown in FIG. 2.

Cavity 114 is suitably sized to accommodate circuit board components 126. As shown in the side view of antenna unit 100 in FIG. 5, cavity 114 in ground plane 110 extends downwardly below ground plane surface 112. Upon being secured to ground plane 110, circuit board 120 covers cavity 114 and encloses circuit board components 126 to protect them from EMI. Accordingly, ground top surface 122 of platform 120 is positioned near-coplanar with surface 112 of ground plane 110.

Figure 7:
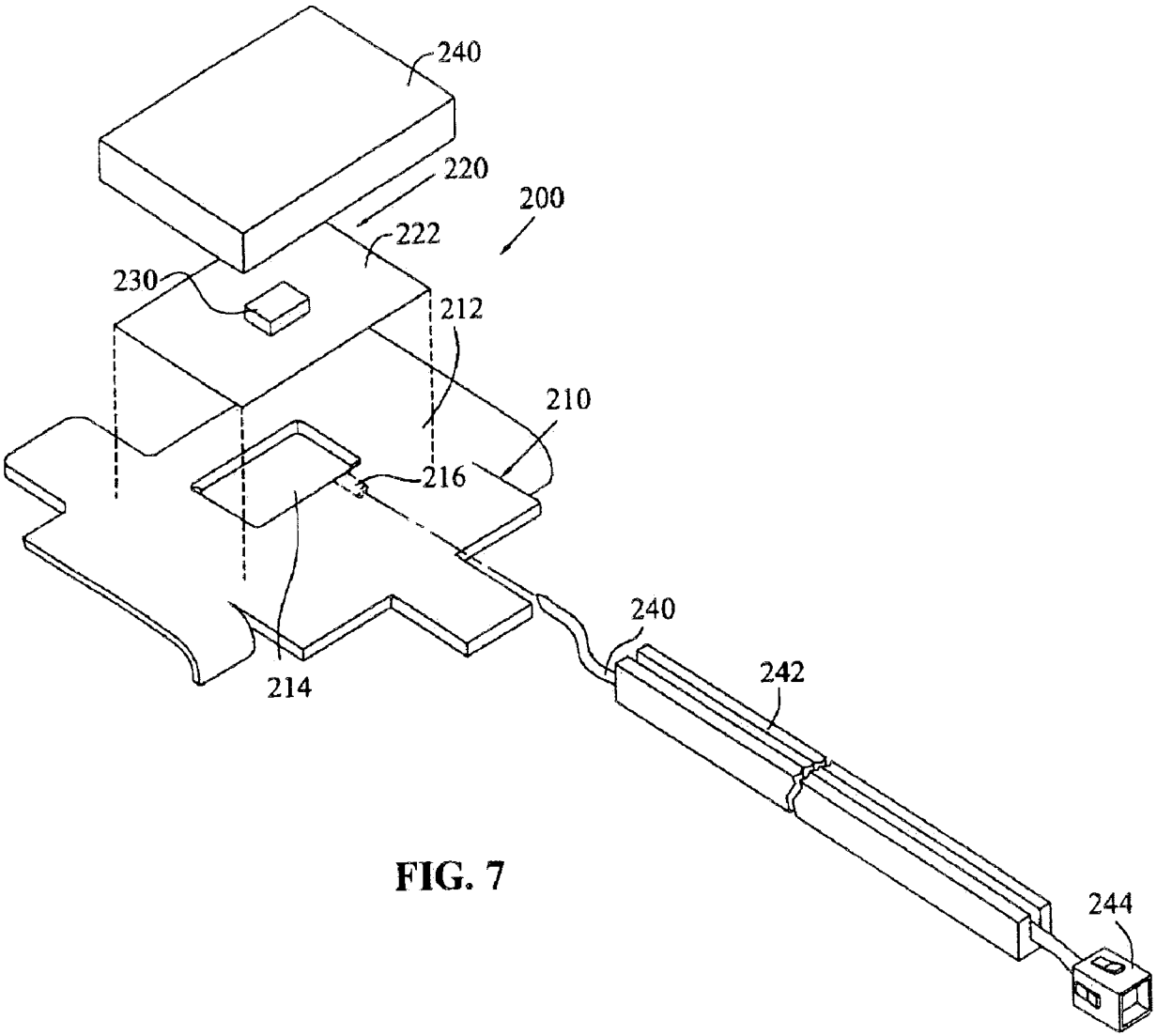
FIG. 7 is an exploded perspective view of a second embodiment of the present invention.

Another embodiment of the present invention is shown in FIG. 7. Antenna unit 200 differs from antenna unit 100 of FIG. 3 in at least two aspects. First, antenna unit 200 includes non-conductive protective layer 240 that covers and protects antenna 230. Protective layer 240 may be a foam pad adhered to antenna 230, a thermoform adhesive covering antenna 230, or another known material capable of covering and protecting antenna 230. Antenna unit 200 also differs from antenna unit 100 of FIG. 3 in that ground plane 210 is configured differently than ground plane 110 (FIG. 2), thus allowing antenna unit 200 to be used in vehicles different from those in which antenna unit 100 may be used.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

We claim:

1. An antenna unit comprising:

a planar member composed of a material operating as a ground plane for said antenna unit, said ground plane defining a cavity;

a circuit board secured to said ground plane, said circuit board including a platform with a grounded surface and at least one circuit board component, said platform grounded surface extending over the cavity so as to enclose the circuit board component within the cavity and provide continuity in the around plane; and an antenna positioned adjacent to said platform and in communication with said circuit board.

2. The antenna unit of claim 1 wherein said platform includes a bottom surface, the bottom surface defining at least one of each a populated and an unpopulated area, the populated area defined by the circuit board component.

3. The antenna unit of claim 1 wherein the platform grounded surface is near-coplanar with the ground plane's surface.

4. The antenna unit of claim 1 wherein the platform grounded surface is coplanar with the ground plane's surface.

5. The antenna unit of claim 1 wherein the antenna is capable of receiving satellite signals.

6. The antenna unit of claim 1 wherein said antenna is mounted to said platform.

7. The antenna unit of claim 1 wherein said antenna is centered above the ground plane.

8. The antenna unit of claim 1 wherein said planar member is made of steel.

9. The antenna unit of claim 1 wherein said planar member is made of brass.

10. The antenna unit of claim 1 wherein said planar member is made of aluminum.

11. An antenna unit comprising:

a planar member composed of a material operating as a ground plane for said antenna unit, said ground plane having a surface and defining a cavity;

a circuit board secured to said ground plane, the circuit board including a platform having a top grounded surface and a bottom surface, the bottom surface containing at least one circuit board component, wherein said platform's top grounded surface extends over the cavity so as to enclose the circuit board component within the cavity and provide continuity in the surface of the ground plane; and an antenna mounted to the top surface of said platform.

12. The antenna unit of claim 11 wherein the bottom surface defines at least one of each a populated and an unpopulated area.

13. The antenna unit of claim 12 wherein the populated area is defined by the circuit board component.

14. The antenna unit of claim 11 wherein the top grounded surface of the platform is coplanar with the ground plane's surface.

15. The antenna unit of claim 11 wherein the top grounded surface of the platform is near-coplanar with the ground plane's surface.

16. The antenna unit of claim 11 wherein said antenna is centered above the ground plane.

17. The antenna unit of claim 11 wherein said planar member is made of steel.

18. The antenna unit of claim 11 wherein said planar member is made of brass.

19. The antenna unit of claim 11 wherein said planar member is made of aluminum.

20. An antenna unit comprising:

an antenna capable of receiving satellite signals, said antenna coupled to a circuit board including a platform with a grounded surface; said antenna including a planar member composed of a material operating as a ground plane, said ground plane defining a cavity; said circuit board secured to the ground plane and containing at least one circuit board component, wherein the platform grounded surface extends over the cavity, thereby encapsulating the circuit board component within the cavity and providing continuity in the ground plane; and a protective layer covering said antenna.

21. The antenna unit of claim 20 wherein said platform includes a bottom surface, the bottom surface defining at least one of each a populated area and an unpopulated area, the populated area defined by the circuit board component.

22. The antenna unit of claim 20 wherein the platform grounded surface is coplanar with the ground plane's surface.

23. The antenna unit of claim 20 wherein the platform grounded surface is near-coplanar with the ground plane's surface.

24. The antenna unit of claim 20 wherein said antenna is centered above the ground plane.

25. The antenna unit of claim 20 wherein said planar member is made of steel.

26. The antenna unit of claim 20 wherein said planar member is made of brass.

27. The antenna unit of claim 20 wherein said planar member is made of aluminum.

* * * * *